US011053054B2

(12) United States Patent
Habitz

(10) Patent No.: US 11,053,054 B2
(45) Date of Patent: Jul. 6, 2021

(54) SPOUT FITMENT AND CAP

(71) Applicant: Gateway Plastics, Inc., Mequon, WI (US)

(72) Inventor: Arthur W. Habitz, Milwaukee, WI (US)

(73) Assignee: Gateway Plastics, Inc., Mequon, WI (US)

( * ) Notice: Subject to any disclaimer, the term of this patent is extended or adjusted under 35 U.S.C. 154(b) by 0 days.

(21) Appl. No.: 16/530,414

(22) Filed: Aug. 2, 2019

(65) Prior Publication Data

US 2020/0039704 A1 Feb. 6, 2020

Related U.S. Application Data

(60) Provisional application No. 62/714,264, filed on Aug. 3, 2018.

(51) Int. Cl.
*B65D 47/12* (2006.01)

(52) U.S. Cl.
CPC ..... *B65D 47/128* (2013.01)

(58) Field of Classification Search
CPC ..... B65D 47/128; B65D 47/243; B65D 47/20–305; B65D 47/121; B65D 47/122
See application file for complete search history.

(56) References Cited

U.S. PATENT DOCUMENTS 1,601,818 A * 10/1926 Fusay ..... B65D 47/242 222/520
3,276,640 A * 10/1966 Kessler ..... B65D 47/243 222/525
3,439,842 A 4/1969 Stull
3,738,545 A 6/1973 Roy
5,104,008 A 4/1992 Crisci
5,472,120 A * 12/1995 Stebick ..... B65D 47/243 222/153.06
5,606,844 A 3/1997 Takagaki et al.
5,609,276 A 3/1997 Greatbatch
5,971,613 A 10/1999 Bell
6,000,848 A 12/1999 Massioui
6,224,528 B1 5/2001 Bell
6,230,944 B1 * 5/2001 Castellano ..... B65D 47/243 222/481.5
6,241,122 B1 6/2001 Araki et al.
(Continued)

FOREIGN PATENT DOCUMENTS

EP 1114780 A1 * 7/2001 ..... B29C 45/006

*Primary Examiner* — Vishal Pancholi
*Assistant Examiner* — Bob Zadeh
(74) *Attorney, Agent, or Firm* — Foley & Lardner LLP

(57) ABSTRACT

A spout fitment and cap assembly for a dispensing container is provided. The spout fitment and cap assembly includes a fitment and a cap. The fitment includes a generally tubular shape surrounding a central axial passage and multiple horizontal sealing ribs configured to secure the fitment to the dispensing container. The cap includes a generally tubular shape with an annular wall extending circumferentially about an exterior surface of the tubular shape, a central plug portion, and multiple flow openings surrounding the central plug portion. The cap is slidably coupled to the fitment and is configured to be actuated between a first position and a second position through an application of force to the annular wall.

20 Claims, 6 Drawing Sheets

(56) References Cited

U.S. PATENT DOCUMENTS

| | | | | |
|---|---|---|---|---|
| 6,257,463 | B1 * | 7/2001 | De Polo | B65D 41/3428 222/525 |
| 6,592,918 | B2 | 7/2003 | Kaeser | |
| 6,860,406 | B2 | 3/2005 | Kobetsky et al. | |
| 6,938,794 | B2 | 9/2005 | Elder | |
| D544,096 | S | 6/2007 | Walters et al. | |
| 7,661,560 | B2 | 2/2010 | Murray | |
| 7,762,414 | B2 | 7/2010 | Uytterhaeghe et al. | |
| 8,276,793 | B2 | 10/2012 | Dicks et al. | |
| 8,292,121 | B2 | 10/2012 | Davideit et al. | |
| 8,459,512 | B2 | 6/2013 | Arvizu | |
| 8,474,665 | B2 | 7/2013 | Arvizu | |
| 8,777,058 | B2 | 7/2014 | Haefele et al. | |
| 9,290,308 | B2 | 3/2016 | Bashyam et al. | |
| 9,428,308 | B2 * | 8/2016 | Bet | B65D 47/243 |
| 9,751,677 | B2 | 9/2017 | Fiere et al. | |
| 2003/0230546 | A1 * | 12/2003 | Yurkewicz | B65D 41/32 215/251 |
| 2006/0043113 | A1 * | 3/2006 | Verespej | B65D 47/0814 222/153.01 |
| 2007/0262100 | A1 * | 11/2007 | Murray | B65D 47/147 222/525 |
| 2008/0023502 | A1 * | 1/2008 | Knes | B65D 47/243 222/524 |
| 2014/0197126 | A1 * | 7/2014 | Bet | B65D 47/243 215/364 |
| 2015/0151318 | A1 | 6/2015 | Murray | |
| 2015/0197380 | A1 * | 7/2015 | Bashyam | B65D 47/243 222/522 |
| 2017/0081086 | A1 | 3/2017 | Fiere et al. | |
| 2017/0096273 | A1 | 4/2017 | Mazurkiewicz et al. | |
| 2017/0152080 | A1 | 6/2017 | Zoppas | |
| 2017/0334627 | A1 | 11/2017 | Fiere et al. | |

* cited by examiner

SECTION A-A

SPOUT FITMENT AND CAP

CROSS REFERENCE TO RELATED PATENT APPLICATION

The present application claims the benefit under 35 U.S.C. § 119(e) of U.S. Provisional Application No. 62/714,264, having a filing date of Aug. 3, 2018, titled "Spout Fitment and Cap," the disclosure of which is hereby incorporated by reference in its entirety.

BACKGROUND

The present disclosure relates generally to a spout fitment and cap assembly utilized for the dispensing of flowable product from a crushable dispensing container without requiring the use of any additional components (e.g., straws). A number of consumer goods are sold in such dispensing containers, including, but not limited to, foodstuffs (e.g., applesauce, condiments, juices), personal care products (e.g., shampoos, liquid soaps, lotions), and other household products (e.g., detergents, automotive oils). A spout fitment and cap assembly optimized for these containers would therefore be useful.

SUMMARY

One implementation of the present disclosure is a spout fitment and cap assembly for a dispensing container. The spout fitment and cap assembly includes a fitment and a cap. The fitment includes a generally tubular shape surrounding a central axial passage and multiple horizontal sealing ribs configured to secure the fitment to the dispensing container. The cap includes a generally tubular shape with an annular wall extending circumferentially about an exterior surface of the tubular shape, a central plug portion, and multiple flow openings surrounding the central plug portion. The cap is slidably coupled to the fitment and is configured to be actuated between a first position and a second position through an application of force to the annular wall.

In some embodiments, the first position is a closed position and the second position is an open position. In other embodiments, fitment further includes an external lip and the cap further includes a first ring and a second ring. In some embodiments, the external lip and the first ring are configured to interlock to retain the cap in the closed position. In some embodiments, the external lip and the second ring are configured to interlock when the cap is in the open position to prevent decoupling of the cap and the fitment.

In some embodiments, the cap includes five flow openings. In some embodiments, the fitment includes four horizontal sealing ribs.

In some embodiments, the fitment includes a circumferential rib configured to provide an audible indication that the cap is in the closed position.

In some embodiments, the fitment includes multiple vertical ribs coupled to the horizontal sealing ribs.

In some embodiments, the cap and the fitment are each fabricated from polypropylene.

Another implementation of the present disclosure is a spout fitment and cap assembly for a dispensing container. The spout fitment and cap assembly includes a fitment and a cap. The fitment includes a generally tubular shape surrounding a central axial passage and multiple horizontal sealing ribs configured to secure the fitment to the dispensing container. The cap includes a generally tubular shape with an annular wall extending circumferentially about an exterior surface of the tubular shape, a central plug portion, and multiple flow openings surrounding the central plug portion. The cap is slidably coupled to the fitment and is configured to be actuated between a first position, a second position, and a third position through an application of force to the annular wall.

In some embodiments, the first position is a closed position, the second position is a partially open position, and the third position is an open position. In other embodiment, the fitment includes a first external lip and a second external lip, and the cap includes a first ring and a second ring. In some embodiments, the first external lip and the first ring are configured to interlock to retain the cap in the closed position. In some embodiments, the second external lip and the second ring are configured to interlock to retain the cap in the partially open position. In some embodiments, the first external lip and the second ring are configured to interlock when the cap is in the open position to prevent decoupling of the cap and the fitment.

DETAILED DESCRIPTION

Overview

Referring generally to the FIGURES, a spout fitment and cap assembly for a dispensing container is shown according to various exemplary embodiments. The cap assembly includes a fitment and a cap that is slidably coupled to the fitment. The cap may be actuated between a closed position and an open position. The cap includes a plug portion that is configured to prevent the flow of product when the cap is in the closed position and multiple flow openings that permit the flow of product when the cap is in the open position. The fitment includes multiple sealing ribs that may be used to couple the cap assembly to the dispensing container using an ultrasonic bonding process.

Before discussing further details of the valve for the dispensing container and/or the components thereof, it should be noted that references to "front," "back," "rear," "upper," "lower," "inner," "outer," "right," and "left," and other directions in this description are merely used to identify the various elements as they are oriented in the FIGURES. These terms are not meant to limit the element which they describe, as the various elements may be oriented differently in various applications. Additionally, any dimensions or sizes specified for the valve for the dispensing container and/or the components thereof should be interpreted as describing an exemplary embodiment and should not be regarded as limiting. The spout fitment and cap assembly and the dispensing container can have any of a variety of shapes and/or sizes in various applications.

Spout Fitment and Cap Assembly

Figure 1:
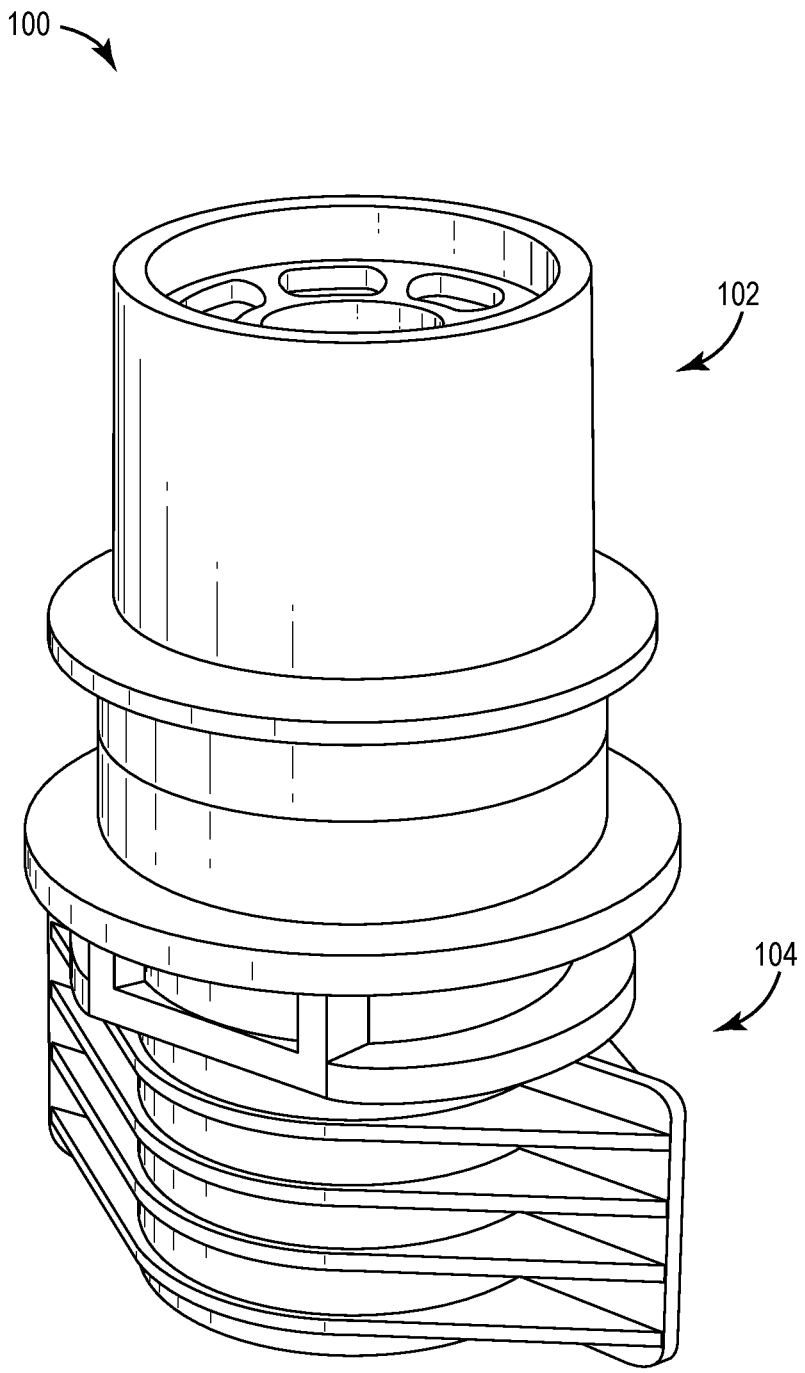
FIG. 1 is a perspective view of a spout fitment and cap assembly for a dispensing container in a closed position, according to an exemplary embodiment.
Figure 2:
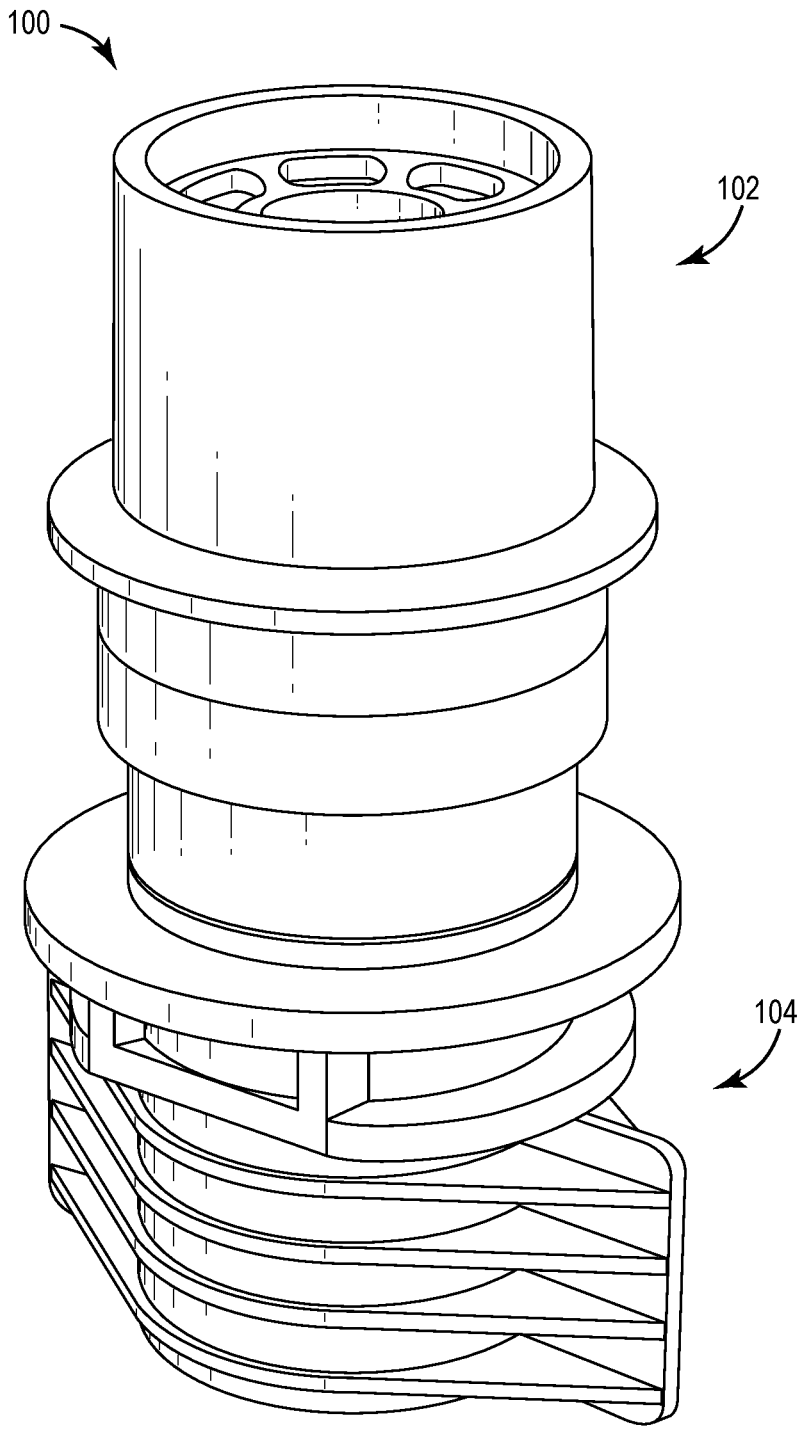
FIG. 2 is a perspective view of the spout fitment and cap assembly of FIG. 1 in an open position, according to an exemplary embodiment.

Referring now to FIGS. 1 and 2, perspective views of a spout fitment and cap assembly 100 for a dispensing container are shown. Specifically, FIG. 1 depicts the spout fitment and cap assembly 100 in a closed position, while FIG. 2 depicts the spout fitment and cap assembly 100 in an open position. The spout fitment and cap assembly 100 includes a cap 102 that is slidably coupled to a fitment 104 such that the dispensing container may be opened and resealed multiple times until all of the product within the container has been dispensed. When the cap 102 is translated upwards (i.e., "pulled") relative to the fitment 104, the assembly 100 is transitioned from the closed position to the open position and the contents of the dispensing container are permitted to freely flow through the cap 102. When the cap 102 is translated downwards (i.e., "pushed") relative to the fitment 104, the assembly 100 is transitioned from the open position to the closed position and the contents of the dispensing container are prevented from flowing through Turning now to FIGS. 3 and 4, cross-sectional views of the spout fitment and cap assembly 100 in the closed and open positions are respectively depicted, according to various embodiments. As shown, the cap 102 has a generally tubular shape and includes a central plug portion 106 that is surrounded by multiple flow openings 108. In contrast to push-pull cap assembly designs commonly used for water bottles and the like, the plug portion 106 is a component of the slidable cap 102, rather than the stationary fitment 104.

The cap 102 is further shown to include an annular wall 110 that extends circumferentially about an exterior wall of the cap 102. The annular wall 110 may provide an actuating surface for a user to grip as the cap 102 is transitioned between the closed and open positions. By providing a designated portion of the cap 102 for a user to grip, the user is directed away from gripping features of the cap 102 in contact with the substance contained within the dispensing container. This may be particularly advantageous when the substance contained within the dispensing container is a food or beverage product, and sanitary dispensing is of particular concern. In some embodiments, the annular wall 110 may function as a sealing surface for a shrink seal (not shown) that is formed over the cap 102. The shrink seal may provide tamper evidence to ensure the integrity of the contents of the dispensing container, and may protect the eating/drinking surfaces of the cap 102 from contamination.

The fitment 104 includes a side wall having a generally tubular shape. The fitment 104 has a fitment first end and a fitment second end. The side wall is continuous between the fitment first end and the fitment second end. The fitment 104 is shown to include a central axial passage 112 that directs the flow of product vertically upwards and out of the dispensing container through the flow openings 108 of the cap 102. The central axial passage 112 may terminate near the plug portion 106 of the cap 102 with a radial lip 120 that extends toward the center of the axial passage 112 and around the circumference of the central axial passage 112. The radial lip 120 may be configured to interlock with the central plug portion 106 of the cap 102 in order to maintain the cap 102 in the closed position and to prevent leakage of the contents of the dispensing container when the cap 102 is in the closed position.

The fitment 104 further includes an annular wall 114 and multiple horizontal sealing ribs 116. Horizontal sealing ribs 116 may be used in the process used to couple the fitment 104 to the dispensing container. In an exemplary embodiment, an ultrasonic assembly process (e.g., ultrasonic welding) is utilized. Ultrasonic assembly may be accomplished through conversion of high frequency electrical energy into high frequency mechanical motion. When applied under pressure, the high frequency mechanical motion creates frictional heat at a joint area between two or more thermoplastic parts that is sufficient to cause melting and flow at the joint area. Once cooled, the two or more parts are bonded together by a homogeneous molecular bond. Although the fitment 104 is depicted as having four horizontal sealing ribs 116, in other embodiments, the fitment 104 may include any number of horizontal sealing ribs 116 required to securely couple the cap assembly 100 to the dispensing feature.

Figure 4:
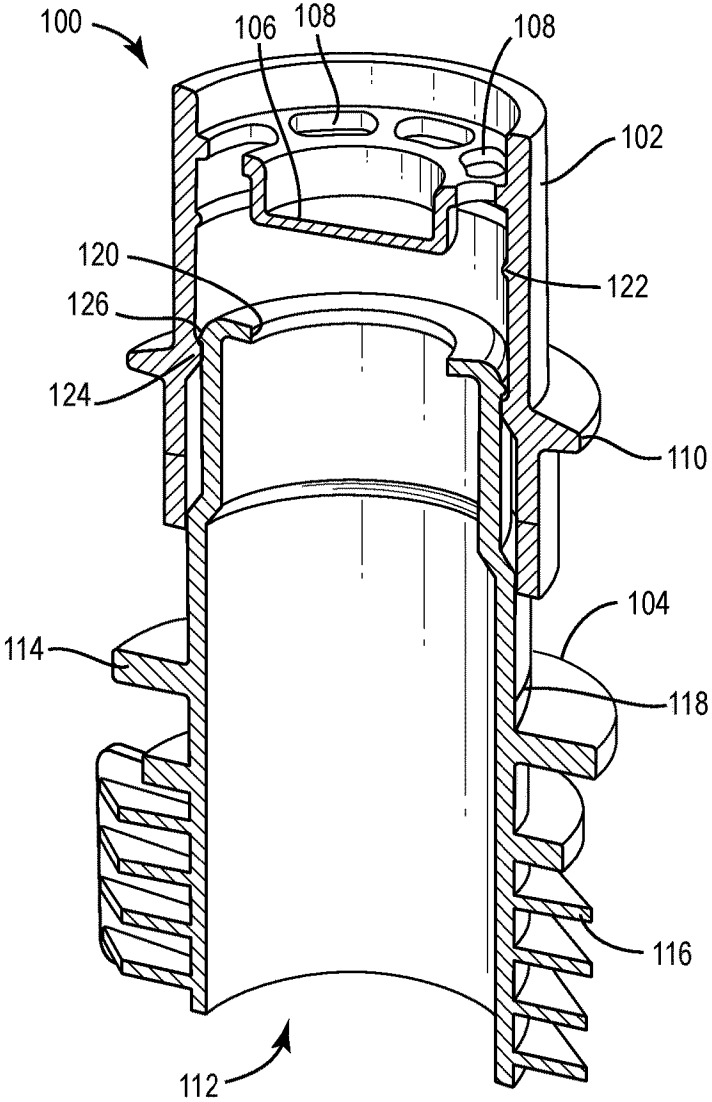
FIG. 4 is a perspective cross-sectional view of the spout fitment and cap assembly of FIG. 1 in the open position, according to an exemplary embodiment.
Figure 3:
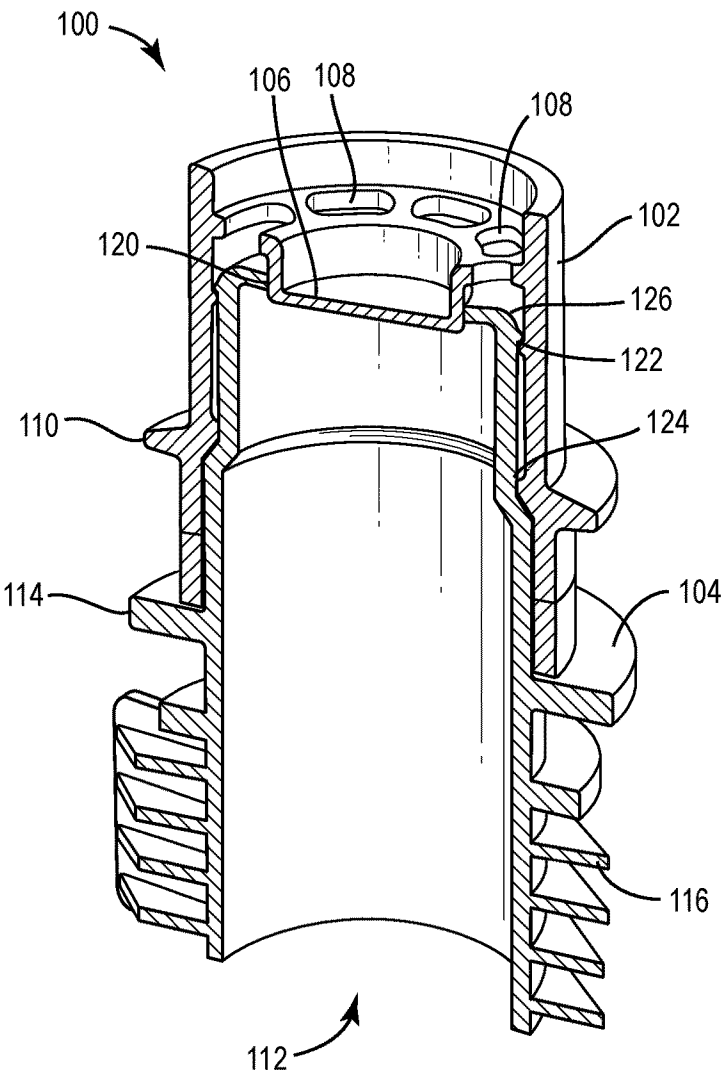
FIG. 3 is a perspective cross-sectional view of the spout fitment and cap assembly of FIG. 1 in the closed position, according to an exemplary embodiment.

The cap assembly 100 may include several additional features configured to ensure the position of the cap 102 is maintained relative to the fitment 104, whether it be the closed or open position. For example, as depicted in FIG. 3, when the cap 102 is in the closed position, a first ring 122 protruding from an interior surface of the cap 102 is configured to interlock with an external lip 126. Although the interaction between the first ring 122 and the external lip 126 is configured to maintain the cap 102 in the closed position, only a small amount of force may be required to transition the cap 102 from the closed position to the open position. For example, a user may be able to apply a sufficient amount of force with only two fingers on the annular wall 110. Once the cap 102 has been transitioned to the open position, as depicted in FIG. 4, a second ring 124 protruding from and interior surface of the cap 102 is configured to interlock with the external lip 126 and prevent decoupling of the cap 102 from the fitment 104. By preventing the cap 102 from being separated from the fitment 104, any potential choking hazards associated with a loose cap 102 are minimized.

In some embodiments, the fitment 104 further includes a cap closure rib 118 disposed near the annular wall 114 and extending around the circumference of the fitment 104. As the cap 102 is transitioned from the open position to the closed position, translation of an interior surface of the cap 102 over the cap closure rib 118 may produce an audible clicking or snapping sound, which may serve as an indication to a user that the cap 102 has been successfully returned to the closed position.

Figure 6:
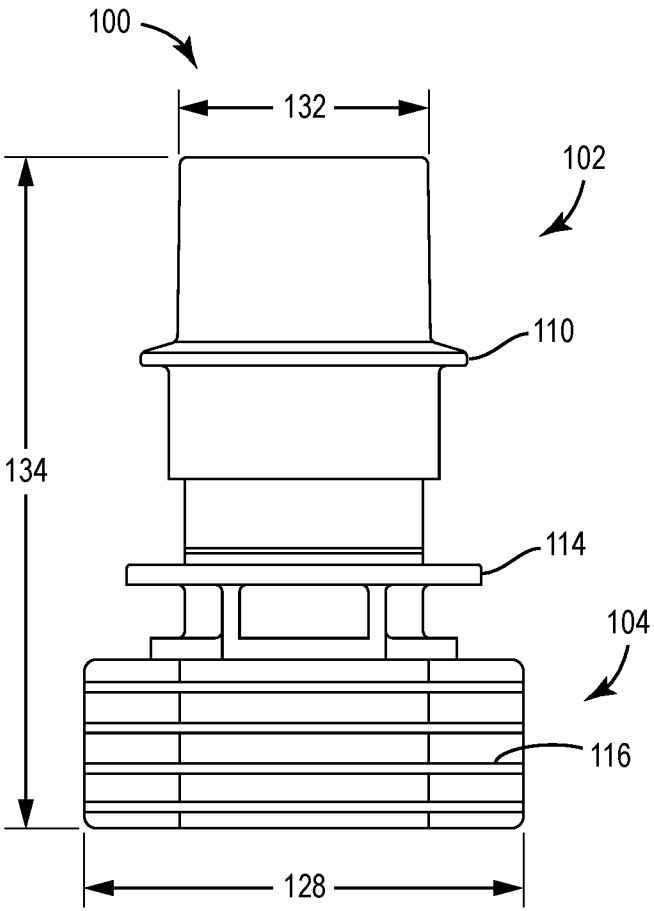
FIG. 6 is a front elevation view of the spout fitment and cap assembly of FIG. 1 in the open position, according to an exemplary embodiment.
Figure 5:
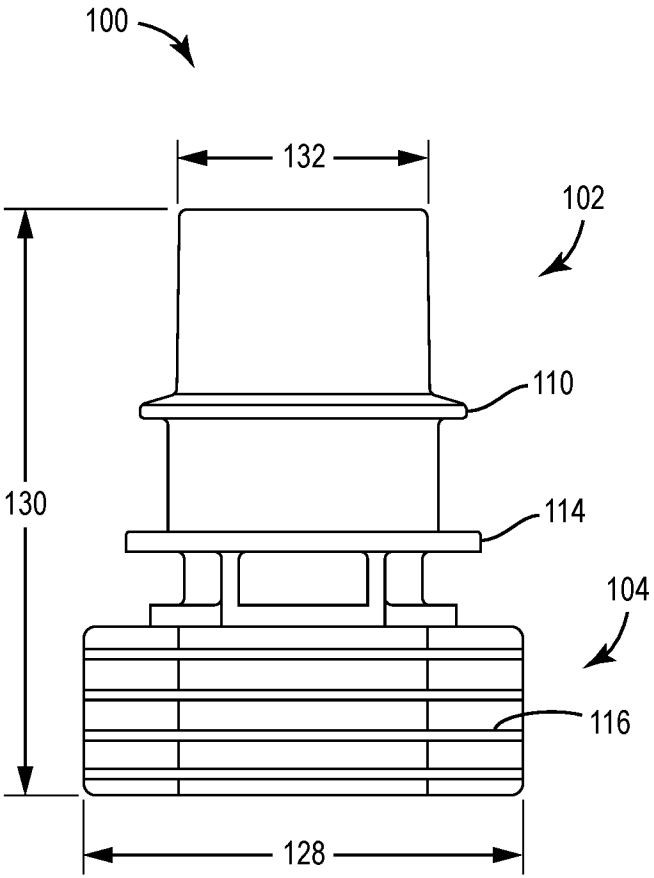
FIG. 5 is a front elevation view of the spout fitment and cap assembly of FIG. 1 in the closed position, according to an exemplary embodiment.

Since the physical dimensions of the dispensing container may vary depending on manufacturing considerations, as well as the particular material to be dispensed, the spout fitment and cap assembly 100 may likewise encompass a range of physical dimensions without straying from the embodiments disclosed in the present application. FIGS. 5-8 depict an exemplary cap assembly 100 that may be utilized on a dispensing container for a foodstuff (e.g., applesauce). Referring now to FIG. 5, a front elevation view of the spout fitment and cap assembly 100 in the closed position is depicted. In an exemplary embodiment, the nominal width 128 of the fitment 104 may be approximately 1.00 inches, while the nominal height 130 of the cap assembly 100 in the closed position may be approximately 1.33 inches. The nominal diameter 132 of the cap 102 may be approximately 0.57 inches. FIG. 6 depicts a front elevation view of the spout fitment and cap assembly 100 in the open position. In an exemplary embodiment, the nominal height 134 of the cap assembly 100 in the open position may be approximately 1.54 inches.

Figure 8:
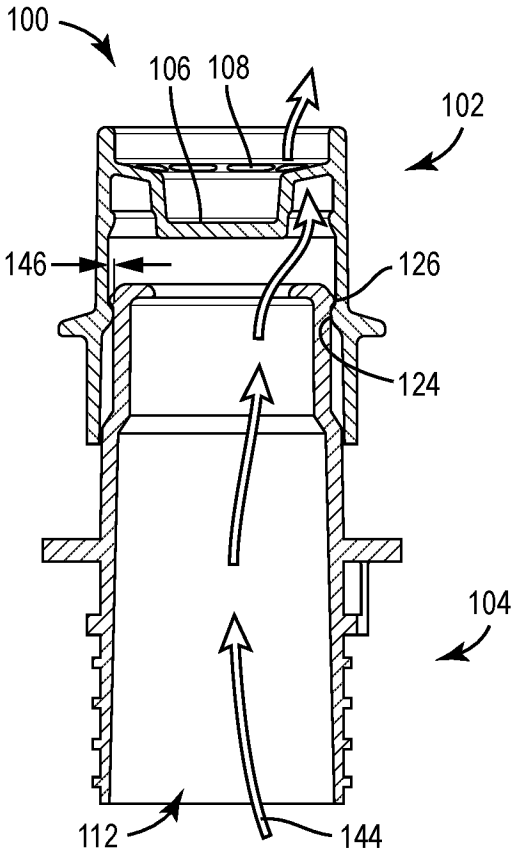
FIG. 8 is a side cross-sectional view of the spout fitment and cap assembly taken along the line A-A in FIG. 7, according to an exemplary embodiment.
Figure 7:
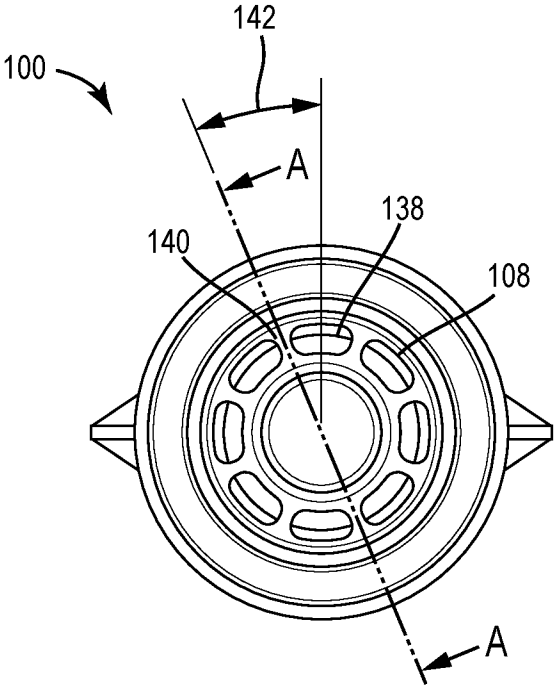
FIG. 7 is a top elevation view of the spout fitment and cap assembly of FIG. 1 in the open position, according to an exemplary embodiment.

Turning now to FIGS. 7 and 8, top and cross-sectional views of the cap assembly 100 in the open position are respectively depicted. As shown in FIG. 7, the cap 102 includes multiple flow openings 108 evenly distributed about the circumference of the plug portion 106 such that the angular dimension 142 between a centerpoint 138 of a flow opening 108 and the centerpoint 140 of a connecting rib located between each of the flow openings 108 is approximately 22.5°. Although FIG. 7 specifically depicts a cap 102 having eight flow openings 108, the cap 102 may include any number of flow openings 108 requires to achieve desired flow characteristics through the cap assembly 100. For example, in some embodiments, the cap 102 has five flow openings 108 which may be larger than the flow openings 108 depicted in FIG. 7. Similarly, flow openings 108 may have any geometry (e.g., rounded rectangle, circle, oval) required to achieve desired flow through the cap assembly 100.

Referring now to FIG. 8, a sectional view of the cap assembly 100 about the line A-A of FIG. 7 is depicted. As shown, when the cap assembly 100 is in the open position, product from the dispensing container is permitted to flow in the direction indicated by arrow 144, traveling through the axial passage 112 of the fitment 104, around the plug portion 106 and through the flow openings 108 of the cap 102. FIG. 8 additionally depicts the interaction of the cap retention features included in the cap assembly 100 when the cap 102 is in the open position. As described above, the second ring 124 of the cap 102 is configured to interlock with an external lip 126 of the fitment 104 to prevent decoupling of the cap 102 from the fitment 104. In an exemplary embodiment, the nominal gap 146 between these features is 0.011 inches.

In an exemplary embodiment, both the cap 102 and the fitment 104 are fabricated from polypropylene (PP). PP is a thermoplastic polymer with advantageous characteristics including good chemical resistance, toughness, and fatigue resistance. In various embodiments, the cap 102 and the fitment 104 may be fabricated from a different polymer material (e.g., polyethylene, polyurethane). In some embodiments, the cap 102 and the fitment 104 are fabricated using an injection molding process, although any suitable fabrication process may be utilized. Once fabricated and assembled, the cap assembly 100 is configured to be installed on a dispensing container immediately after the dispensing container is filled with flowable product.

Figure 9:
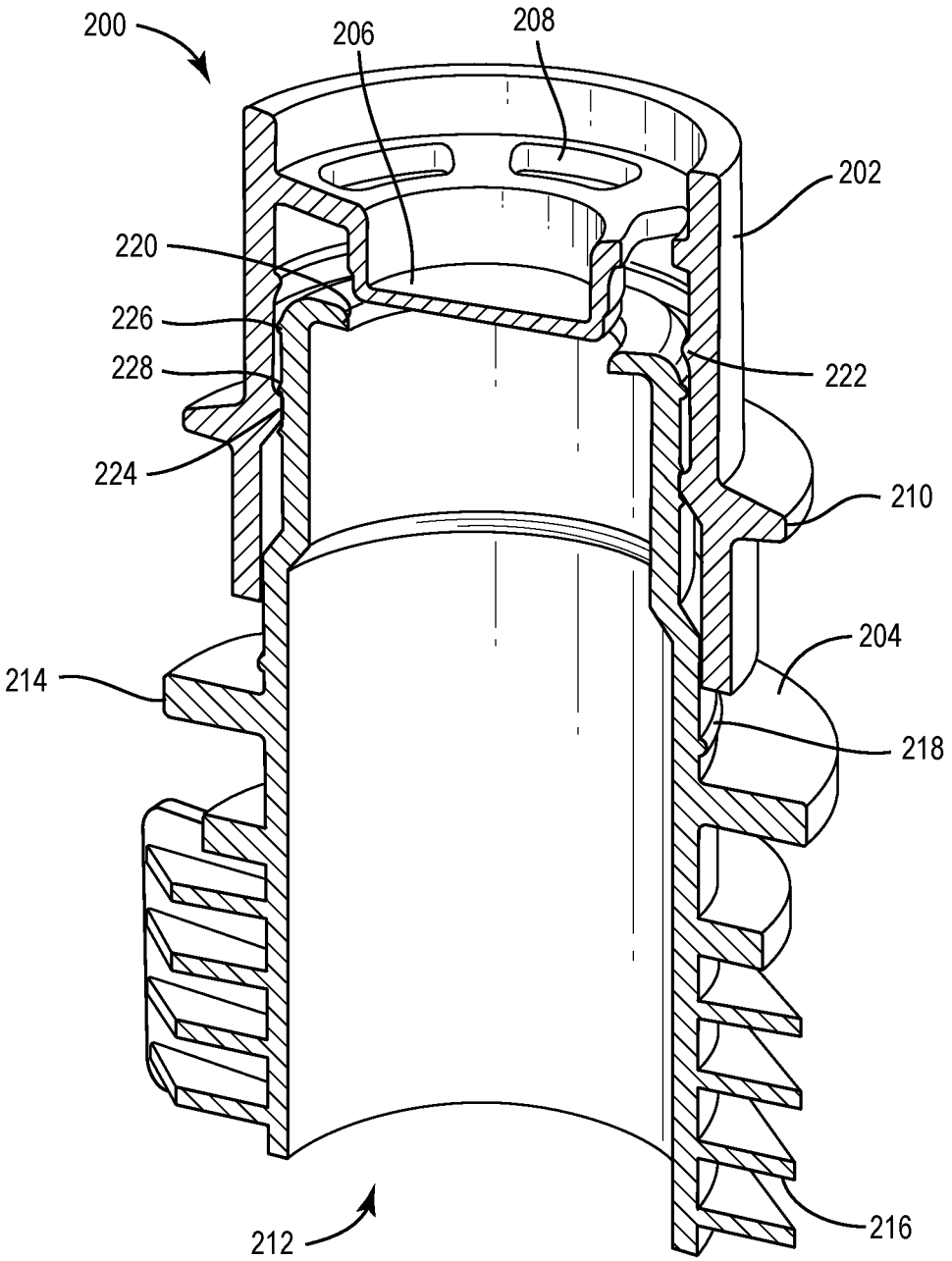
FIG. 9 is a perspective view of a spout fitment and cap assembly for a dispensing container in a partially open position, according to another exemplary embodiment.

Turning now to FIG. 9, another embodiment of a spout fitment and cap assembly 200 is depicted. Similar to cap assembly 100, described above with reference to FIGS. 1-8, cap assembly 200 includes a cap 202 and a fitment 204. However, in contrast to cap assembly 100, cap assembly 200 includes features that permit the cap 202 to be actuated between a closed position, an open position, and a partially open position that is either midway or any other position between the closed position and the open position. The partially open position may permit the product within the dispenser to flow through the cap assembly 200 at a slower, or metered, flow rate as compared with the open position.

Cap 202 is shown to include a central plug portion 206, multiple flow openings 208, and an annular wall 210. Fitment 204 includes a central axial passage 212, an annular wall 214, multiple horizontal sealing ribs 216, and a cap closure rib 218. When the cap 202 is in the closed position, a first ring 222 protruding from an interior surface of the cap 202 is configured to interlock with a first external lip 226. When the cap 202 is in the partially open position, as is depicted in FIG. 9, a second ring 224 protruding from an interior surface of the cap 202 is configured to interlock with a second external lip 228. When the cap 202 is in the open position, the second ring 224 is configured to interlock with the first external lip 226 to prevent decoupling of the cap 202 from the fitment 204. The cap 202 may be actuated between the closed, partially open, and open positions through forces applied to the annular wall 210 of the cap 202.

In some embodiments, the fitment 204 additionally includes one or more vertical ribs (not shown) near the second external lip 228. The vertical ribs may be configured to prevent rotation of the cap 202 relative to the fitment 204. The vertical ribs may also act as stepping on the fitment 204 for flow metering purposes in order to control the flow rate out of the cap assembly 200.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

In the present disclosure, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A spout fitment and cap assembly for a dispensing container, the spout fitment and cap assembly comprising:

a fitment comprising:

a fitment first end;

a fitment second end opposite the fitment first end;

a sidewall disposed between the fitment first end and the fitment second end and having a generally tubular shape defining a central axis, the sidewall surrounding a central axial passage centered on the central axis and being continuous between the fitment first end and the fitment second end;

a plurality of exterior ribs extending outwards from the fitment first end;

a radial lip extending radially inwards from the fitment second end, the radial lip defining a lip opening; and a plurality of horizontal sealing ribs configured to secure the fitment to the dispensing container, the plurality of horizontal sealing ribs centered on the central axis; and a cap comprising:

a generally tubular shape centered on the central axis and having an annular wall centered on the central axis and extending circumferentially about an exterior surface of the generally tubular shape;

a central plug portion configured to be received within the lip opening and to interface with the radial lip around the lip opening when the central plug portion is received within the lip opening; and a plurality of flow openings surrounding the central plug portion;

wherein the cap is slidably coupled to the fitment and is configured to be actuated between a first position and a second position through an application of force to the annular wall.

2. The spout fitment and cap assembly of claim 1, wherein the first position is a closed position and the second position is an open position.

3. The spout fitment and cap assembly of claim 2, wherein the fitment further comprises an external lip and the cap further comprises a first ring and a second ring.

4. The spout fitment and cap assembly of claim 3, wherein the external lip and the first ring are configured to interlock to retain the cap in the closed position.

5. The spout fitment and cap assembly of claim 3, wherein the external lip and the second ring are configured to interlock when the cap is in the open position to prevent decoupling of the cap and the fitment.

6. The spout fitment and cap assembly of claim 2, wherein the fitment further comprises a circumferential rib configured to provide an audible indication that the cap is in the closed position.

7. The spout fitment and cap assembly of claim 1, wherein the plurality of flow openings comprises five flow openings.

8. The spout fitment and cap assembly of claim 1, wherein the plurality of horizontal sealing ribs comprises four horizontal sealing ribs.

9. The spout fitment and cap assembly of claim 1, wherein the cap and the fitment are each fabricated from polypropylene.

10. A spout fitment and cap assembly for a dispensing container, the spout fitment and cap assembly comprising:

a fitment comprising:

a fitment first end;

a fitment second end opposite the fitment first end;

a sidewall having a generally tubular shape and disposed between the fitment first end and the fitment second end, the sidewall surrounding a central axial passage and being continuous between the fitment first end and the fitment second end;

a plurality of exterior ribs extending outwards from the fitment first end;

a radial lip extending radially inwards from the fitment second end, the radial lip defining a lip opening; and a plurality of horizontal sealing ribs configured to secure the fitment to the dispensing container;

a cap comprising:

a generally tubular shape with an annular wall extending radially outward from an exterior surface of the generally tubular shape;

a central plug portion configured to be received within the lip opening and to interface with the radial lip around the lip opening when the central plug portion is received within the lip opening; and a plurality of flow openings surrounding the central plug portion;

wherein the cap is slidably coupled to the fitment and is configured to be actuated between a first position, a second position, and a third position through an application of force to the annular wall.

11. The spout fitment and cap assembly of claim 10, wherein the first position is a closed position, the second position is a partially open position, and the third position is an open position.

12. The spout fitment and cap assembly of claim 11, wherein the fitment further comprises a first external lip and a second external lip, and wherein the cap further comprises a first ring and a second ring.

13. The spout fitment and cap assembly of claim 12, wherein the first external lip and the first ring are configured to interlock to retain the cap in the closed position.

14. The spout fitment and cap assembly of claim 12, wherein the second external lip and the second ring are configured to interlock to retain the cap in the partially open position.

15. The spout fitment and cap assembly of claim 12, wherein the first external lip and the second ring are configured to interlock when the cap is in the open position to prevent decoupling of the cap and the fitment.

16. An assembly for a dispensing container, the assembly comprising:

a fitment, comprising:

a fitment first end;

a fitment second end opposite the fitment first end;

a side wall having a generally tubular shape, the side wall surrounding a central axis passage and being continuous between the fitment first end and the fitment second end;

a plurality of ribs extending outwards from the fitment first end; and a lip extending radially inwards from the fitment second end, the lip defining a lip opening; and a cap slidably coupled to the fitment, the cap comprising:

a cap first end;

a cap second end opposite the cap first end;

a plug disposed at the cap second end and configured to be received within the lip opening and to interface with the lip around the lip opening when the plug is received within the lip opening; and a plurality of flow openings disposed around the plug.

17. The assembly of claim 16, wherein:

the cap is configured to be operable between a first position and a second position;

the fitment is configured to receive the cap such that the fitment and the cap are concentric;

the fitment and the cap are configured to facilitate fluid communication between the fitment first end and the plurality of flow openings when the cap is in the first position; and the lip defines an aperture configured to sealably receive the plug such that the fluid communication between the fitment first end and the plurality of flow openings is blocked when the cap is in the second position.

18. The assembly of claim 17, wherein:

the fitment further comprises a fitment ring extending radially outwards from the fitment and disposed at the fitment second end; and the cap further comprises:

a first ring extending radially inward from the cap, disposed between the cap first end and the plug, and configured to selectively interlock with the fitment ring when the cap is in the first position such that the cap is selectively retained in the first position; and a second ring extending radially inward from the cap, disposed between the cap first end and the first ring, and configured to selectively interlock with the fitment ring when the cap is in the second position such that the cap is selectively retained in the second position.

19. The assembly of claim 18, wherein the fitment further comprises:

a first diameter at the fitment first end;

a second diameter, less than the first diameter, at the fitment second end; and an annular wall disposed between the plurality of ribs and the lip, extending radially outward from the fitment, and configured to contact the cap first end when the cap is in the second position.

20. The assembly of claim 19, wherein the fitment further comprises a closure rib disposed between the fitment first end and the fitment second end and configured to provide an audible indication that the cap is in the second position.

* * * * *